US007997400B2

(12) United States Patent
Gonzalez Alemany et al.

(10) Patent No.: US 7,997,400 B2
(45) Date of Patent: Aug. 16, 2011

(54) TRANSPORT SYSTEM FOR THE MOVEMENT OF PASSENGERS/GOODS

(75) Inventors: Miguel Angel Gonzalez Alemany, Mierer (ES); Juan Domingo Gonzalez Pantiga, Gijon (ES); Manuel Alonso Cuello, Gijon (ES); Abdón Muniz Camblor, Oviedo (ES)

(73) Assignees: Thyssenkrupp Norte, S.A., Mieres, Asturias (ES); Thyssenkrupp Elevator (ES/PBB) Ltd., London (GB)

( * ) Notice: Subject to any disclaimer, the term of this patent is extended or adjusted under 35 U.S.C. 154(b) by 0 days.

(21) Appl. No.: 12/580,675

(22) Filed: Oct. 16, 2009

(65) Prior Publication Data

US 2010/0181163 A1 Jul. 22, 2010

Related U.S. Application Data

(63) Continuation of application No. 11/965,308, filed on Dec. 27, 2007, now abandoned.

(30) Foreign Application Priority Data

Dec. 29, 2006 (ES) ..... 200603324

(51) Int. Cl.
*B66B 21/12* (2006.01)

(52) U.S. Cl. ..... 198/334; 198/330

(58) Field of Classification Search ..... 198/330, 198/334

See application file for complete search history.

(56) References Cited

U.S. PATENT DOCUMENTS

| | | | | |
|---|---|---|---|---|
| 3,672,484 | A | 6/1972 | Angioletti et al. | |
| 3,712,448 | A * | 1/1973 | Burson et al. | 198/334 |
| 3,939,959 | A * | 2/1976 | Dunstan et al. | 198/334 |
| 4,444,302 | A * | 4/1984 | Dunstan | 198/334 |
| 4,509,429 | A * | 4/1985 | de Broqueville | 198/334 |
| 5,571,254 | A * | 11/1996 | Saeki et al. | 198/334 |
| 6,138,816 | A | 10/2000 | Sato et al. | |
| 6,675,949 | B1 | 1/2004 | Gonzalez Alemany et al. | |

FOREIGN PATENT DOCUMENTS

| | | |
|---|---|---|
| EP | 0 646 538 | 3/1999 |
| EP | 1 253 101 | 8/2003 |
| ES | 2 179 720 | 1/2003 |
| GB | 1185913 | 3/1970 |
| GB | 1 383 785 | 2/1975 |
| GB | 2 328 193 | 2/1999 |
| JP | 3-152087 | 6/1991 |

* cited by examiner

*Primary Examiner* — James R Bidwell
(74) *Attorney, Agent, or Firm* — Merchant & Gould P.C.

(57) ABSTRACT

A transport system for the movement of passengers/goods formed by a moving endless belt having: a series of pallet assemblies; drive equipment for transmitting a drive movement from actuating equipment to the pallet assemblies in a low speed section located in an embarking/disembarking area of the endless belt; drive equipment for transmitting a drive movement from actuating equipment to the pallet assemblies in a high speed section located in a middle area of the endless belt; and drive equipment for transmitting a drive movement from actuation equipment (400") to the pallet assemblies in a transitional speed section located between the embarking/disembarking area and the middle area of the endless belt.

21 Claims, 7 Drawing Sheets

TRANSPORT SYSTEM FOR THE MOVEMENT OF PASSENGERS/GOODS

This application is Continuation of U.S. Ser. No. 11/965,308, filed 27 Dec. 2007, which claims benefit of Serial No. 200603324, filed 29 Dec. 2006 in Spain and which applications are incorporated herein by reference. To the extent appropriate, a claim of priority is made to each of the above disclosed applications.

FIELD OF THE INVENTION

The invention relates to a transport system for the movement of passengers/goods and, more particularly, to a system having low speed sections located in an embarking/disembarking area, a high speed section located in a middle area, and transition speed sections located between the embarking/disembarking area and the middle area.

The invention is applied to mechanical walkways such as those used in airports, stations and generally in large public places in which users must walk more or less large sections and in which it is intended to make this type of movement easier.

BACKGROUND OF THE INVENTION

It is common to find mechanical walkways like those mentioned above in which various sections are established, acting at different speeds such that, according to the operating direction thereof, a first embarking area having a slow speed, an acceleration area, a maximum speed intermediate area, a deceleration area, and a slow speed disembarking area are established in the walkway.

To achieve the variable speed which is necessary in the acceleration and deceleration areas, there are different solutions including the one provided in ES2179720. Said document describes an acceleration walkway with a moving surface formed by plate assemblies, each one formed by a front plate and a rear plate, hinged to one another according to an axis perpendicular to the operating direction. The rear plate of each assembly is assembled on lateral guides and chains, whereas front plate is connected to the rear plate of the plate assembly located immediately in front of it. The chains are formed by bent and straight links and are driven between lateral guides causing the tilting of the links. The walkway includes embarking and disembarking areas in which the plates circulate at slow speed, a central area in which the plates circulate at fast speed, and two transition areas in which the plates accelerate and decelerate as a result of the folding or unfolding of the lateral chains.

SUMMARY OF THE INVENTION

The present invention provides a transport system in which the drive elements of the pallets have a more simplified operation than in the state of the art closest to the invention. Instead of using a single drive element with a high mechanical complexity to provide sections with different speed profiles, namely low speed in the embarking and disembarking areas, high speed in the central area and the corresponding transition areas between the high and low speed areas, a radically different design is chosen.

Different drive means are used in the present invention for each of the areas with a different speed profile, choosing a the simplest possible design for each of these areas meeting the system requirements; thus, a chain is arranged for the embarking-low speed area, a chain for the disembarking-low speed area, a chain for the central-maximum speed area, a variable pitch screw for the acceleration area from the embarking-low speed area until the central-maximum speed area and a variable pitch screw for the deceleration area from the central-maximum speed area until the disembarking-low speed area.

This arrangement allows greater modularity because any of the system components can be more flexibly chosen and replaced given that each speed area of the system is approached as a subassembly.

Another advantage of the present invention is that since the components are more conventional than in the closest state of the art, their manufacture is much less complicated; therefore, both the initial system cost and the cost of replacing any of its components is substantially less.

Another result of this greater mechanical simplicity is the duration of the system components: they experience less deterioration, which results in a longer useful life of said components, and this translates into a longer system operating time between maintenance stop periods and into greater reliability.

The invention relates to a transport system for the movement of passengers/goods consisting of a moving endless belt comprising:

- a plurality of pallet assemblies in which each assembly:
  - has a support surface configured to support a passenger/good and has variable length;
  - comprises a driven pallet, which driven by a drive pallet, both pallets being hinged to one another according to an axis perpendicular to a movement direction D of the belt;
- actuating means for transmitting an actuating movement from at least one motor;
- characterized in that:
  - it comprises first drive means configured to transmit a drive movement from first actuating means to the pallet belt in a low speed section located in an embarking/disembarking area of the endless belt;
  - it comprises second drive means configured to transmit a drive movement from second actuating means to the pallet belt in a high speed section located in a middle area of the endless belt;
  - it comprises third drive means configured to transmit a drive movement from third actuating means to the pallet belt in a transition speed section located between the embarking/disembarking area and the middle area of the endless belt;
  - the pallets comprise:
    - a functional surface opposite to the support surface and having first meshing means;
  - the first drive means, the second drive means and the third drive means comprise second meshing means having a shape conjugated with the first meshing means, so that the drive pallets are driven by the first drive means, the second drive means and the third drive means by means of a meshing between the first meshing means and the second meshing means and driving said pallet belt in the movement direction D.

The actuating means can be actuated by a single motor which can actuate both the first drive means or low speed-embarking/disembarking chains, and the second drive means or high speed chains and including the third drive means or variable pitch screw. At the other end, each drive means can have its own motor. Intermediate solutions in which different combinations of drive means share motors are also possible.

The first drive means can comprise two pairs of first chains parallel according to the movement direction D, a first pair in the embarking area and a second pair in the disembarking area, and the forward movement and return sections of which run between the forward movement and return sections of the belt.

The second drive means can comprise two second chains parallel according to the movement direction D in the middle area of the endless belt and the forward movement and return sections of which run between the forward movement and return sections of the belt.

The third drive means can comprise two variable pitch screws:

- a first screw in a speed increase section located between the embarking area and the middle area of the endless belt; and
- a second screw in a speed reduction section located between the embarking area and the middle area of the endless belt.

Therefore:

- the first drive means can be located in a first drive level I;
- the second drive means can be located in a second drive level II;
- the third drive means can have a first portion in the first drive level I and a second portion in the second drive level II.

In one configuration of the invention, the first drive level I can be above the second drive level II.

In the system of the invention:

- the first meshing means can comprise a rocking beam having:
  - a first end hinged to the functional surface according to an axis perpendicular to the movement direction D;
  - a second end opposite to the first end having:
    - at least one concave arc perpendicular to the longitudinal movement direction D in the form of a claw;
- the second meshing means can comprise:
  - a drive bushing perpendicular to the longitudinal movement direction D in the first drive means and in the second drive means;

to form a first/second meshing:

- in a direction perpendicular to the longitudinal movement direction D;
- between the first drive means/the second drive means and the drive pallet when the drive bushing is housed in the concave arc.

In one configuration of the invention, the second end can comprise two concave arcs, a first arc for meshing with the first drive means and a second arc for meshing with the second drive means.

In the invention:

- the first meshing means can comprise a rocking beam having:
  - a first end hinged to the functional surface according to an axis perpendicular to the movement direction D;
  - a second end opposite to the first end having:
    - a drive roller perpendicular to the longitudinal movement direction D;
- the second meshing means can comprise:
  - a variable pitch spiral openwork in the third drive means;

to form a third meshing:

- in a direction perpendicular to the longitudinal movement direction D;
- between the third drive means and the drive pallet when the drive roller is driven by the spiral openwork.

The rocking beam can have at least one wheel in the second end configured to roll on a guide running along the belt and acting as a cam to drive a tilting of the rocking beam between first/second meshing and third meshing positions.

The rocking beam can have two arms between the second ends of which the drive roller is located.

When the rocking beam has two arms, it can incorporate a wheel on each of its outer sides. These wheels are configured to roll between the guides running along the belt and acting as cams to cause the tilting of the rocking beam, along the forward movement section of the belt, between a lower position, along the faster speed movement section of the belt, in which the downward lateral claws lock with the chains, and a high position, along the speed variation and lower speed movement sections of the belt, in which said claws are separated from the chains if the transversal roller meshes with one of the variable pitch screws.

These two arms can be parallel.

In the system of the invention:

- the drive pallet can comprise two first lower pulley wheels on each side;
- the driven pallet can comprise a second lower pulley wheel on each side;
- the pulley wheels of each side of both pallets
  - can be located on planes at different distances from a surface of the pallet; and
  - can be configured to move through rails parallel to the movement direction D passing along the path of the belt.

The pulley wheels of each side of both pallets can be located on planes at different distances from the edge adjacent to the pallet.

The second pulley wheels can be located closer to the driven pallet than the first pulley wheels of the drive pallet.

pulley wheels of both sides can be arranged in symmetrical positions in relation to a longitudinal middle plane of the belt.

In the system of the invention, the rails can have a U-shaped cross-section.

In the system of the invention, a component selected from the first chains, the second chains and combinations thereof, said chains being formed based on links and bushings, can comprise:

- a plurality of drive bushings the axis of said drive bushings being co-linear with the axis of the bushings and said drive bushings projecting towards at least one side of the links.

The drive bushing can have a guide wheel at a free end, said guide wheel being configured to be driven by a guide parallel to the movement direction D running along the path of the belt.

The drive bushing can have a length substantially equal to a width of the concave arc.

The system of the invention can comprise a drive bushing for each drive pallet.

In the system of the invention, the guide can have a U-shaped cross section.

BRIEF DESCRIPTION OF THE DRAWINGS

A series of drawings will be very briefly described below aiding to better understand the invention and which are specifically related to an embodiment of said invention, presented as a non-limiting example thereof.

FIG. 3A shows the motors and the first and third actuating means of the invention.

FIG. 3B shows the motors and the first and second actuating means of the invention.

DETAILED DESCRIPTION OF THE PREFERRED EMBODIMENT(S)

Figure 1:
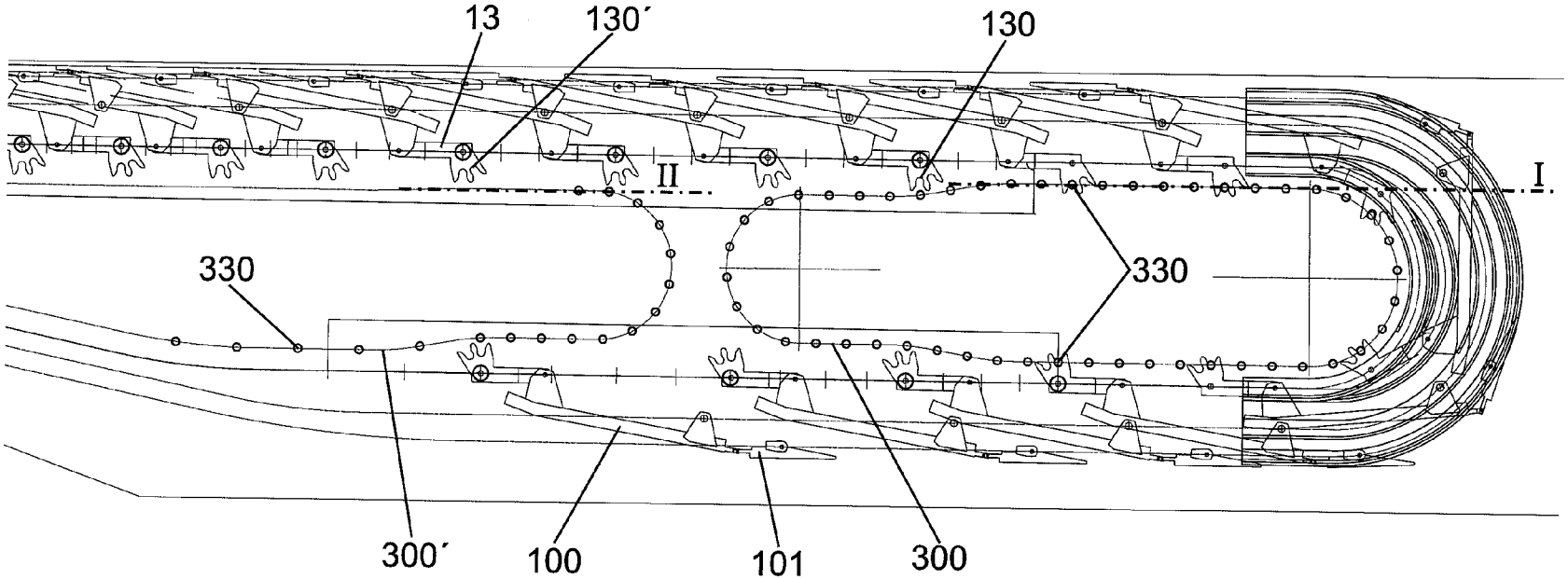
FIG. 1 is a diagram of the system of the invention showing pallet assemblies and first and second drive means.

One embodiment of the invention relates to a transport system for the movement of passengers/goods formed by a moving endless belt comprising:

- a plurality of pallet assemblies (100, 101) in which each assembly:
  - has a support surface (160) configured to support a passenger/good and having variable length;
  - comprises a driven pallet (101) driven by a drive pallet (100), both pallets (100, 101) being hinged to one another according to an axis perpendicular to a movement direction D of the belt;
- actuating means (400, 400', 400") for transmitting an actuating movement from at least one motor (410, 410', 410");

characterized in that:

- it comprises first drive means (300, 320, 321, 310, 311) configured to transmit a drive movement from the first actuating means (400) to the pallet belt (100, 101) in a low speed section located in an embarking/disembarking area of the endless belt;
- it comprises second drive means (300', 310', 311') configured to transmit a drive movement from second actuating means (400') to the pallet belt (100, 101) in a high speed section located in a middle area of the endless belt;
- it comprises third drive means (300") configured to transmit a drive movement from third actuating means (400") to the pallet belt (100, 101) in a transitional speed section located between the embarking/disembarking area and the middle area of the endless belt;
- the pallets (100, 101) comprise:
  - a functional surface opposite to the support surface (160) and having first meshing means (130, 131);
- the first drive means (300, 320, 321, 310, 311), the second drive means (300', 310', 311') and the third drive means (300") comprise second meshing means (330, 331) having a shape conjugated with the first meshing means (130, 131), so that the drive pallets (100) are driven by the first drive means (300, 320, 321, 310, 311), the second drive means (300', 310', 311') and the third drive means (300") by means of a meshing between the first meshing means (130, 131) and the second meshing means (330, 331) and driving said pallet belt (100, 101) in the movement direction D.

The actuating means, can be actuated by a single motor which can actuate both the first drive means (300) or low speed-embarking/disembarking chains, and the second drive means (300') or high speed chains and even the third drive means (300") or variable pitch screw. At the other end, each drive means (300, 300', 300") can have its own motor. Intermediate solutions in which different combinations of drive means (300, 300', 300") share motors are also possible.

The first drive means (300, 320, 321, 310, 311) comprise two pairs of first chains (300) parallel according to the movement direction D, a first pair in the embarking area and a second pair in the disembarking area, and the forward movement and return sections of which run between the forward movement and return sections of the belt.

The first drive chains (300) are actuated by the first drive gear wheels (310, 320), a leading wheel, the first leading drive wheel (310), and a follower wheel, the first follower drive wheel (320), which are supported by drive shafts (311, 321), a motor shaft, the first motor drive shaft (311) and a follower shaft, the first follower drive shaft (321). The first motor drive shaft (311) is actuated by the first actuating means (400) formed by a transmission comprising a plurality of pulleys and belts actuated by a motor (410).

The second drive chains (300') are actuated by second drive gear wheels, a leading wheel, the second leading drive wheel (310') and a follower wheel, the second follower drive wheel (not represented), which are supported by drive shafts, a motor shaft, the second motor drive shaft (311') and a follower wheel, the second follower drive shaft (not represented). The second motor drive shaft (311') is actuated by second actuating means (400') formed by a transmission comprising a plurality of pulleys and belts actuated by a motor (410').

Figure 2:
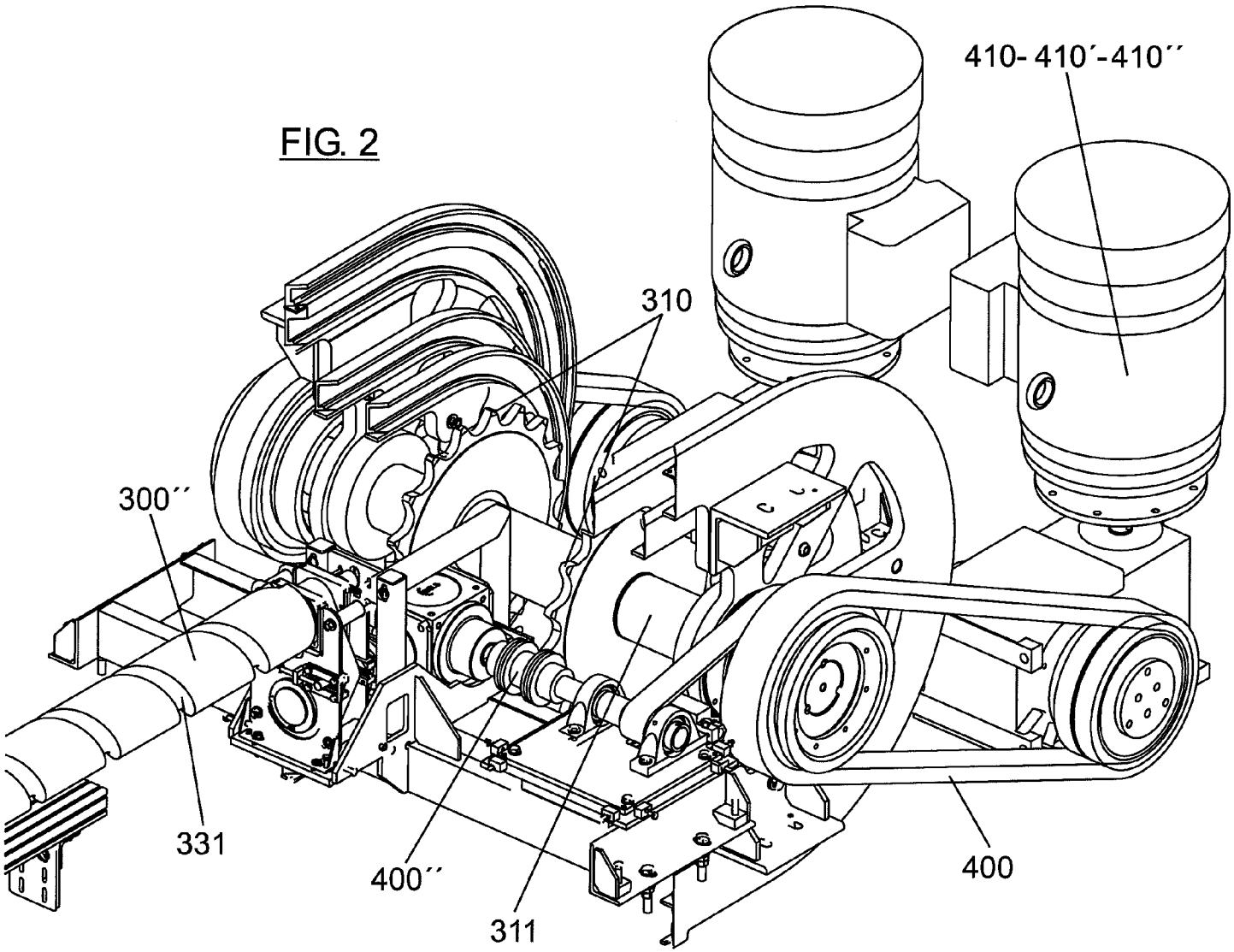
FIG. 2 is a perspective view showing a first configuration of motors and first and third actuating means of the invention.

FIG. 2 shows how the drive screw (300") is actuated by third actuating means (400") formed by a transmission comprising a plurality of shafts and gear wheels taking their movement from the first motor drive shaft (311).

Figure 3A:
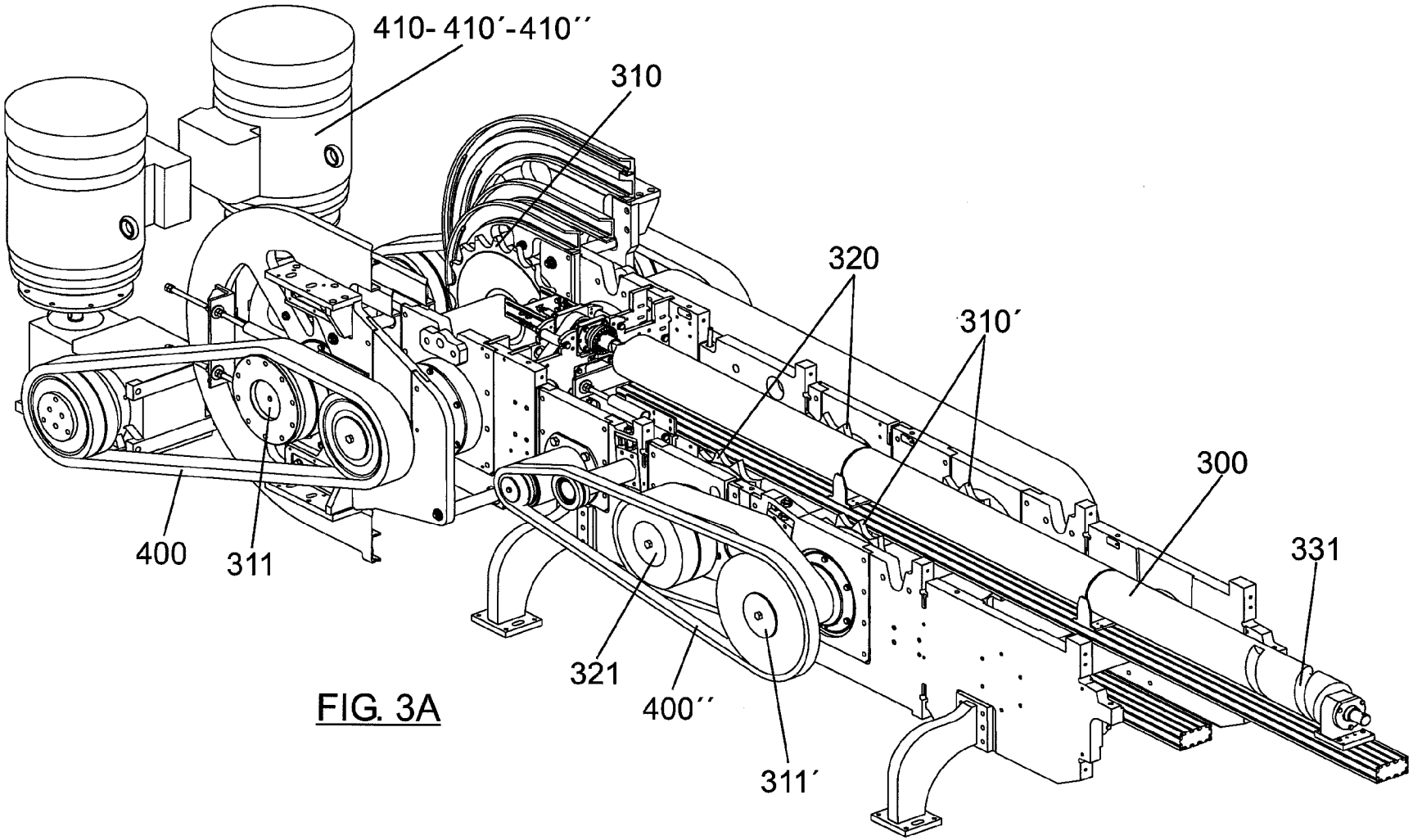
FIG. 3A is a perspective view from a first side showing a second configuration of motors and actuating means of the invention.
Figure 3B:
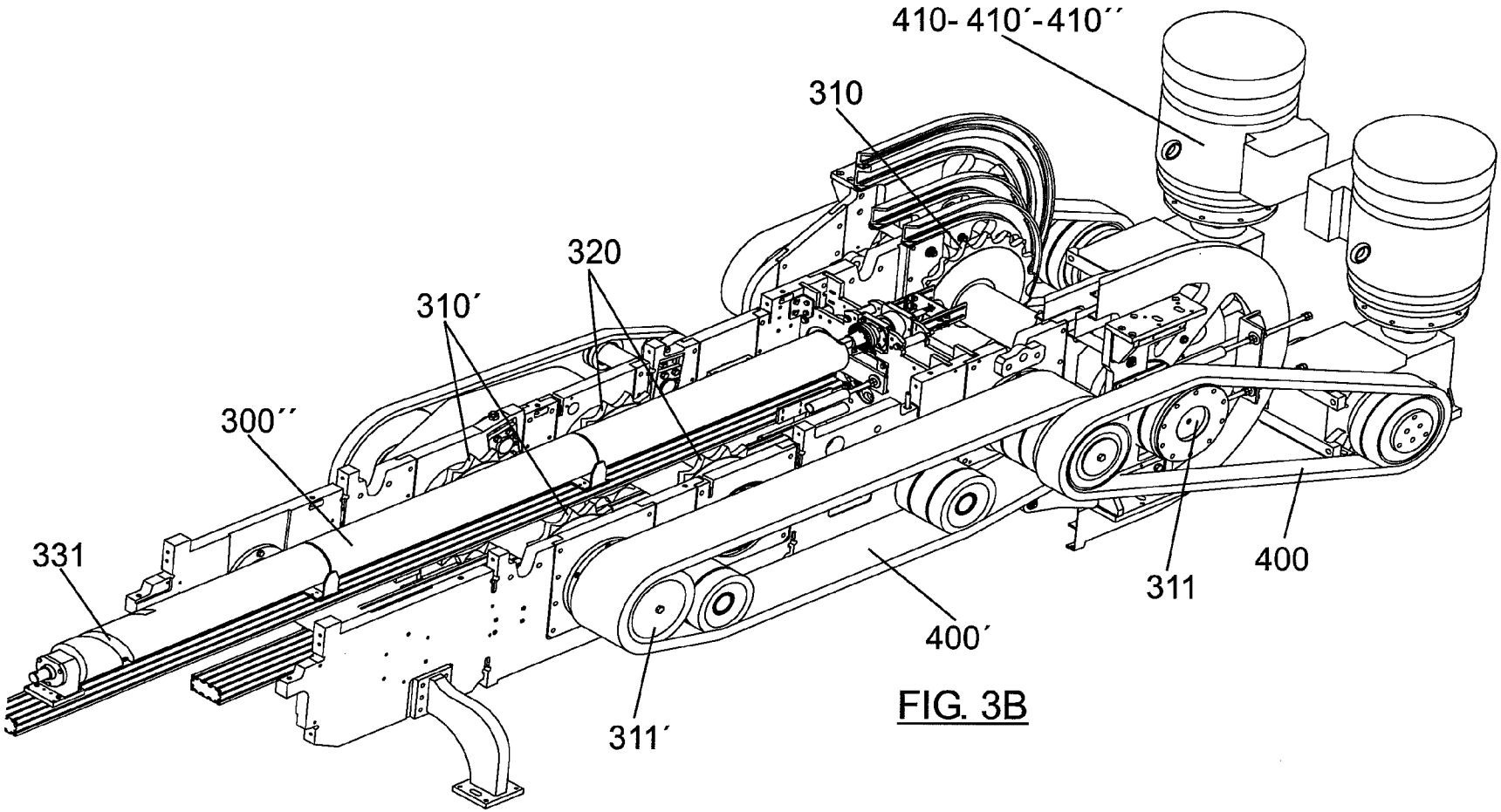
FIG. 3B is a perspective view from a second side showing a second configuration of motors and actuating means of the invention.
Figure 4:
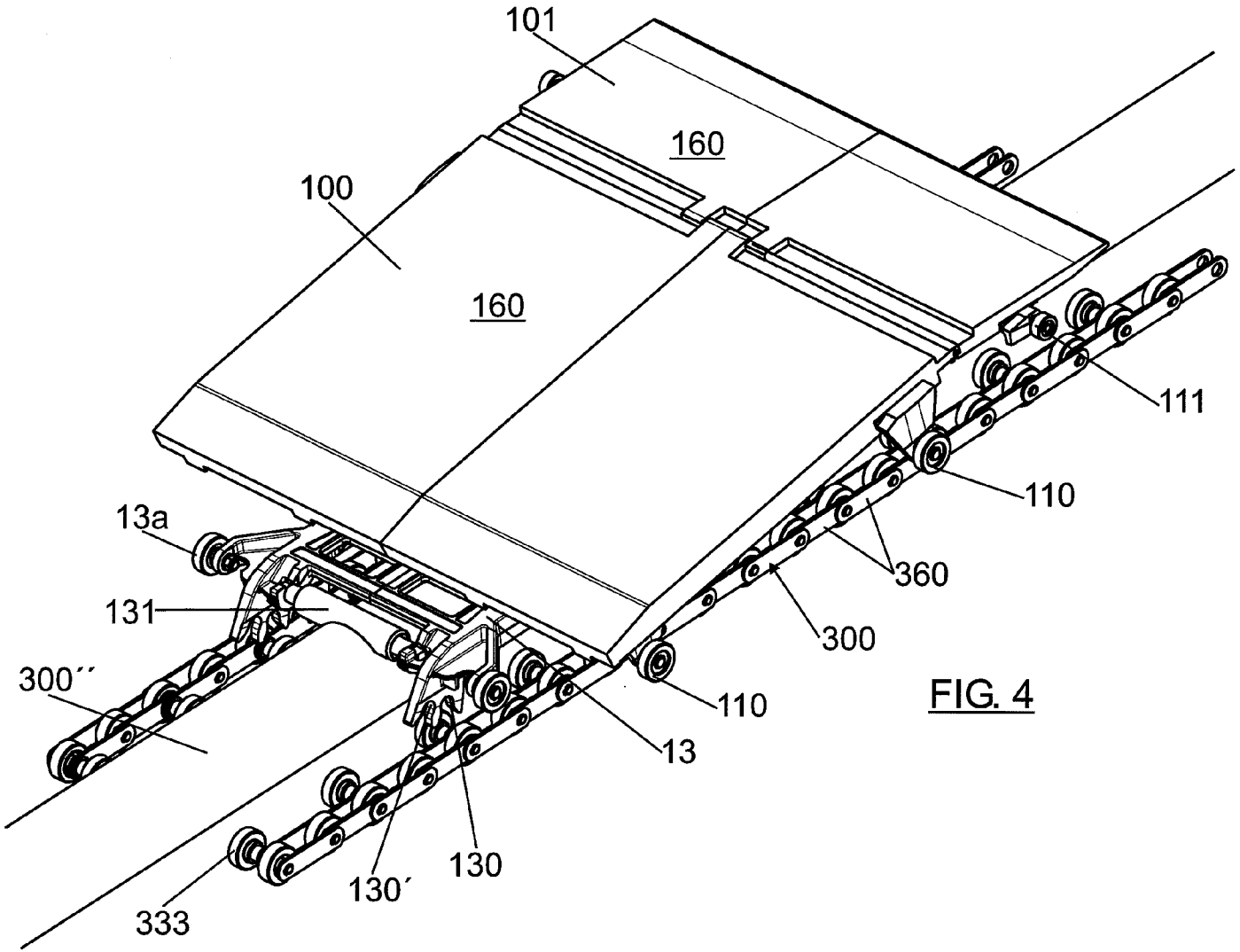
FIG. 4 is a perspective view showing an plate assembly meshed with third drive means.
Figure 5:
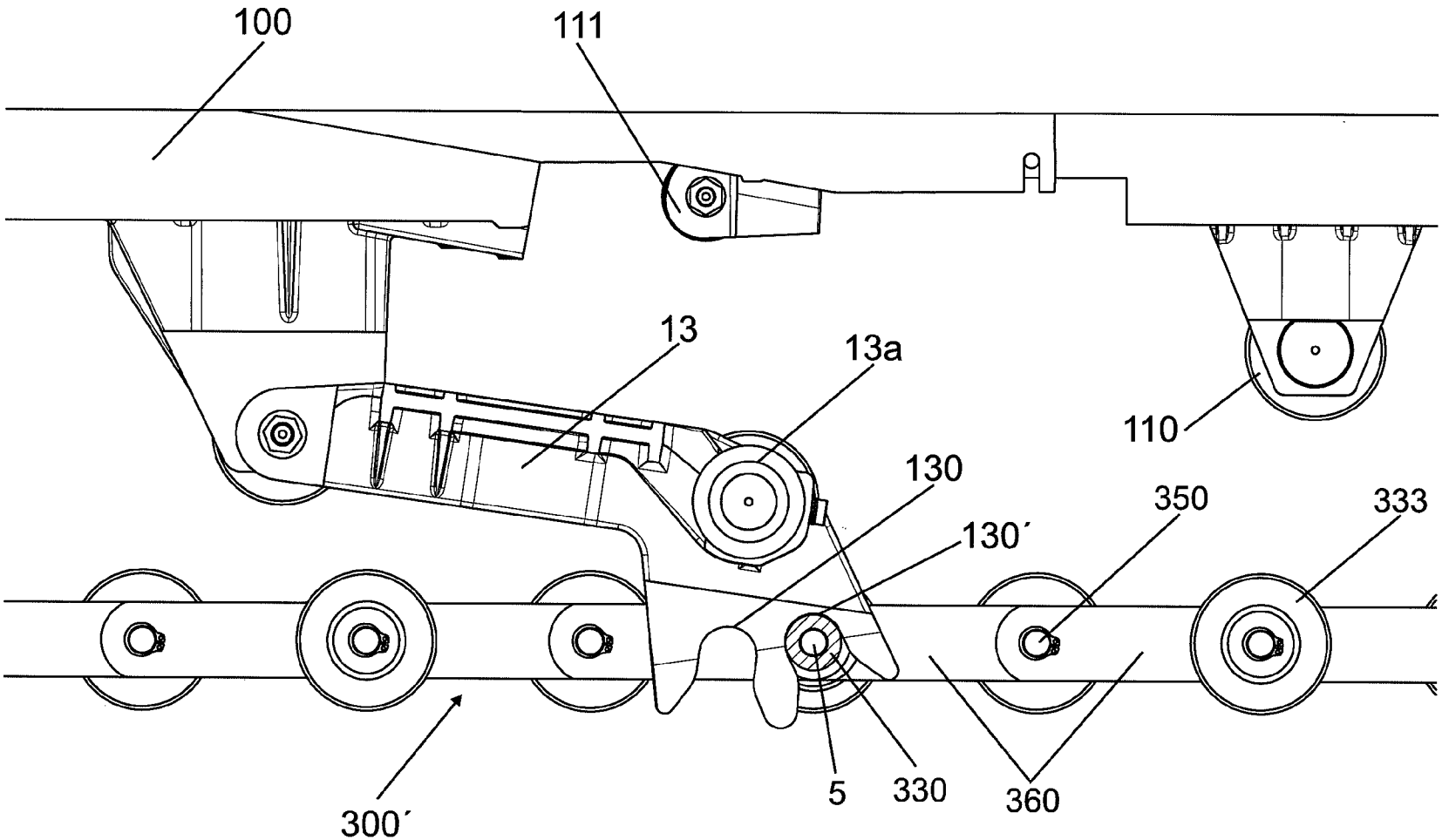
FIG. 5 is a detail showing the rocking beam of the plate assembly, in which a first concave arc is meshed with first drive means.
Figure 6:
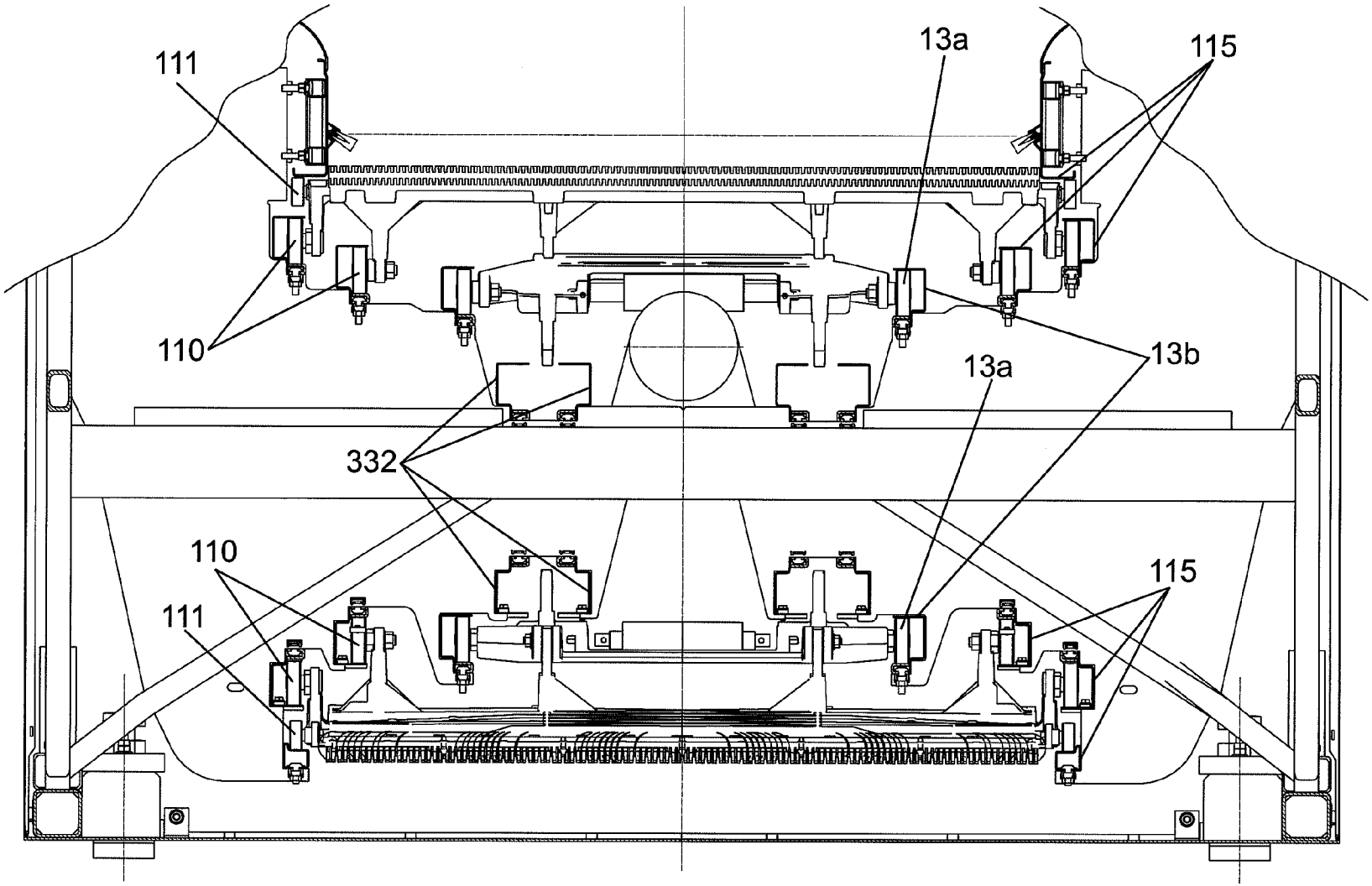
FIG. 6 is a cross-section of the transport system of the invention.

FIG. 3A shows how the drive screw (300") is actuated by third actuating means (400") formed by a transmission comprising a plurality of shafts, gear wheels, belts and pulleys taking their movement from the second motor drive shaft (311').

The second drive means (300', 310', 311') comprise two second chains (300') parallel according to the movement direction D in the middle area of the endless belt and the forward movement and return sections of which run between the forward movement and return sections of the belt.

The third drive means (300") comprise two variable pitch screws:

- a first screw in a speed increase section located between the embarking area and the middle area of the endless belt; and
- a second screw in a speed reduction section located between the embarking area and the middle area of the endless belt.

:

- the first drive means (300, 320, 321, 310, 311) are located in a first drive level I;
- the second drive means (300', 310', 311') are located in a second drive level II;
- the third drive means (300") have a first portion in the first drive level I and a second portion in the second drive level II.

In an embodiment of the invention, the first drive level I is above the second drive level II.

In the system of the invention:

- the first meshing means (130, 131) comprise a rocking beam (13) having:
  - a first end hinged to the functional surface according to an axis perpendicular to the movement direction D; a second end opposite to the first end having:
    - at least one concave arc (130) perpendicular to the longitudinal movement direction D in the form of a claw;

the second meshing means (330, 331) comprise:

a drive bushing (330) perpendicular to the longitudinal movement direction D in the first drive means (300) and in the second drive means (300');

to form a first/second meshing (130-330):

in a direction perpendicular to the longitudinal movement direction D;

between the first drive means (300)/the second drive means (300') and the drive pallet (100) when the drive bushing (330) is housed in the concave arc (130).

In an embodiment of the invention, the second end comprises two concave arcs, a first arc (130) for meshing with the first drive means (300) and a second arc (130') for meshing with the second drive means (300').

In the invention:

the first meshing means (130, 131) comprise a rocking beam (13) having:

a first end hinged to the functional surface according to an axis perpendicular to the movement direction D;

a second end opposite to the first end having:

a drive roller (131) perpendicular to the longitudinal movement direction D;

the second meshing means (330, 331) comprise:

a spiral openwork (331) of variable pitch in the third drive means (300");

to form a third meshing (131-331):

in a direction perpendicular to the longitudinal movement direction D; between the third drive means (300") and the drive pallet (100) when the drive roller (131) is driven by the spiral openwork (331).

The rocking beam (13) has at least one wheel (13*a*) in the second end configured to roll on a guide (13*b*) running along the belt and acting as a cam for driving a tilting of the rocking beam (13) between first/second meshing (130-330) and third meshing (131-331) positions.

The rocking beam (13) has two arms between the second ends of which the drive roller (131) is located.

When the rocking beam (13) has two arms, it can incorporate a wheel on each one of its outer sides. These wheels are configured to roll between guides running along the belt and acting as cams to cause the tilting of the rocking beam (13), along the section of forward movement of the belt, between a lower position, along the faster speed movement section of the belt, in which the downward lateral claws lock with the chains, and a high position, along the speed variation and lower speed movement sections of the belt, in the which said claws are separated from the chains if the transversal roller meshes with one of the variable pitch screws.

These two arms are parallel.

In the system of the invention:

the drive pallet (100) comprises two first lower pulley wheels (110) on each side;

the driven pallet (101) comprises a second lower pulley wheel (111) on each side;

the pulley wheels (110, 111) of each side of both pallets (100, 101)

are located on planes at different distances from a surface of the pallet (100, 101); and are configured to move through rails (115) parallel to the movement direction D running along the path of the belt.

The pulley wheels (110, 111) of each side of both pallets (100, 101) are located on planes at different distances from the adjacent edge of the pallet (100, 101).

The second pulley wheels (111) are located closer to the driven pallet (101) than the first pulley wheels (110) of the drive pallet (100).

The pulley wheels (110, 111) of both sides are arranged in symmetrical positions in relation to a longitudinal middle plane of the belt.

In the system of the invention, the rails (115) have a U-shaped cross-section.

In the system of the invention, a component selected from the first chains (300), the second chains (300') and combinations thereof, said chains being formed based on links (360) and bushings (350), comprises:

a plurality of drive bushings (330) the axis (5) of said drive bushings (330) being co-linear with the axis of the bushings (350) and said drive bushings (330) projecting towards at least one side of the links (360).

The drive bushing (330) has a guide wheel (333) at a free end, said guide wheel (333) being configured to be driven by a guide (332) parallel to the movement direction D running along the path of the belt.

The drive bushing (330) has a length substantially equal to a width of the concave arc (130).

The system of the invention comprises a drive bushing (330) for each drive pallet (100).

In the system of the invention, the guide (332) has a U-shaped cross-section.

The invention claimed is:

1. A transport system for the movement of passengers/goods formed by a moving endless belt comprising:

a plurality of pallet assemblies, wherein a relative difference between pallet assemblies is variable and in which each assembly:

has a support surface configured to support a passenger/good; and comprises a driven pallet driven by a drive pallet hinged to one another according to an axis perpendicular to a movement direction D of the endless belt;

actuating means for transmitting an actuating movement from at least one motor;

first drive means configured to transmit a drive movement from first actuating means to the plurality of pallet assemblies in a low speed section located in an embarking/disembarking area of the endless belt, wherein the first drive means comprise two pairs of first chains parallel according to the movement direction D, a first pair in the embarking area and a second pair in the disembarking area, and forward movement and return sections of which run between forward movement and return sections of the endless belt;

second drive means configured to transmit a drive movement from second actuating means to the plurality of pallet assemblies in a high speed section located in a middle area of the endless belt;

third drive means configured to transmit a drive movement from third actuating means to the plurality of pallet assemblies in a transitional speed section located between the embarking/disembarking area and the middle area of the endless belt; and wherein:

the plurality of pallet assemblies comprise: a functional surface opposite to the support surface and having first meshing means; and the first drive means, the second drive means and the third drive means comprise second meshing means having a shape conjugated with the first meshing means, so that the drive pallets are driven by the first drive means, the second drive means and the third drive means by means of a meshing between the first meshing means and the second meshing means and driving the plurality of pallet assemblies in the movement direction D.

2. The system of claim 1, wherein the second drive means comprise two second chains parallel according to the movement direction D in the middle area of the endless belt and the forward movement and return sections of which run between the forward movement and return sections of the endless belt.

3. The system of claim 1, wherein the third drive means comprise two variable pitch screws:

a first screw in a speed increase section located between the embarking area and the middle area of the endless belt; and a second screw in a speed reduction section located between the disembarking area and the middle area of the endless belt.

4. The system of claim 1, wherein:

the first drive means are located in a first drive level I;

the second drive means are located in a second drive level II;

the third drive means have a first portion in the first drive level I and a second portion in the second drive level II.

5. The system of claim 4, wherein the first drive level I is above the second drive level II.

6. The system of claim 1, wherein:

the first meshing means comprise a rocking beam having:

a first end hinged to the functional surface according to an axis perpendicular to the movement direction D;

a second end opposite to the first end having:

at least one concave arc perpendicular to the longitudinal movement direction D in the form of a claw;

the second meshing means comprise:

a drive bushing perpendicular to the longitudinal movement direction D in the first drive means and in the second drive means;

to form a first/second meshing:

in a direction perpendicular to the longitudinal movement direction D;

between the first drive means the second drive means and the drive pallet when the drive bushing is housed in the concave arc.

7. The system of claim 6, wherein the second end comprises two concave arcs, a first arc for meshing with the first drive means and a second arc for meshing with the second drive means.

8. The system of claim 1, wherein:

the first meshing means comprise a rocking beam having:

a first end hinged to the functional surface according to an axis perpendicular to the movement direction D;

a second end opposite to the first end having:

a drive roller perpendicular to the longitudinal movement direction D;

the second meshing means comprise:

a variable pitch spiral openwork in the third drive means;

to form a third meshing:

in a direction perpendicular to the longitudinal movement direction D;

between the third drive means and the drive pallet when the drive roller is driven by the spiral openwork.

9. The system of claim 6, wherein the rocking beam has at least one wheel in the second end configured to roll on a guide running along the endless belt and acting as a cam for driving a tilting of the rocking beam between positions of first/second meshing and third meshing.

10. The system of claim 8, wherein the rocking beam has two arms between the second ends of which the drive roller is located.

11. The system of claim 10, wherein the arms are parallel.

12. The system of claim 1, wherein:

the drive pallet comprises two first pulley wheels having axes perpendicular to the movement direction D located in positions that are lower than the support surface on each side of the drive pallet;

the driven pallet comprises a second pulley wheel having an axis perpendicular to the movement direction D located in a position that is lower than the support surface on each side of the driven pallet;

the pulley wheels of each side of the drive pallet and the driven pallet are located in parallel planes at different distances from the support surface; and are configured to move through rails parallel to the movement direction D running along the path of the endless belt.

13. The system of claim 12, wherein the pulley wheels of each side of the drive pallet and the driven pallet are located in planes parallel to the movement direction D at different distances from an adjacent pallet assembly edge.

14. The system of claim 12, wherein the second pulley wheels are located closer to the driven pallet than the first pulley wheels of the drive pallet.

15. The system of claim 12, wherein the pulley wheels of both sides are arranged in symmetrical positions in relation to a longitudinal middle plane of the endless belt.

16. The system of claim 12, wherein the rails have a U-shaped cross-section.

17. The system of claim 2, wherein a component selected from the first chains, the second chains and combinations thereof, said chains being formed based on links and chain bushings, comprises:

a plurality of drive bushings the axis of said drive bushings being co-linear with the axis of the chain bushings and the drive bushings being projected towards at least one side of the links.

18. The system of claim 17, wherein the drive bushing has a guide wheel at a free end, said guide wheel being configured to be driven by a guide parallel to the movement direction D running along the path of the endless belt.

19. The system of claim 17, wherein the drive bushing has a length substantially equal to a width of the concave arc.

20. The system of claim 17, wherein it comprises a drive bushing for each drive pallet.

21. The system of claim 17, wherein the guide has a U-shaped cross-section transversal in the form of a U.

* * * * *